US005153648A

United States Patent [19]

Lioy et al.

[11] Patent Number: 5,153,648

[45] Date of Patent: Oct. 6, 1992

[54] ELECTRODE WIRE MOUNTING FOR SCAVENGELESS DEVELOPMENT

[75] Inventors: Gerald T. Lioy, Webster; Jeffrey J. Folkins, Rochester; Thomas J. Behe, Webster, all of N.Y.

[73] Assignee: Xerox Corporation, Stamford, Conn.

[21] Appl. No.: 844,313

[22] Filed: Mar. 2, 1992

[51] Int. Cl.[5] ..... G03G 15/08; G03G 21/00

[52] U.S. Cl. ..... 355/247; 355/259

[58] Field of Search ..... 355/245, 247, 259, 261, 355/263, 221

[56] References Cited

U.S. PATENT DOCUMENTS 4,868,600 9/1989 Hays et al. ..... 355/259
5,010,367 4/1991 Hays ..... 355/247
5,034,775 7/1991 Folkins ..... 355/259
5,063,875 11/1991 Folkins et al. ..... 355/247 X

*Primary Examiner*—Fred L. Braun
*Attorney, Agent, or Firm*—H. Fleischer; J. E. Beck; R. Zibelli

[57] ABSTRACT

An apparatus in which a donor roll advances toner to an electrostatic latent image recorded on a photoconductive member. A plurality of electrode wires are positioned in the space between the donor roll and the photoconductive member. A support contacts the electrode wires at at least two points. One of the contact points is selected to minimize the wire edge angle between with the other of the contact points being selected to minimize the wire free span. In this way, edge banding and strobing effects are minimized.

16 Claims, 3 Drawing Sheets

ELECTRODE WIRE MOUNTING FOR SCAVENGELESS DEVELOPMENT

This invention relates generally to an electrophotographic printing machine, and more particularly concerns a mounting arrangement for electrode wires used in a scavengeless developer unit.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred from the photoconductive surface to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. In jumping development, an AC voltage is applied to the donor roll detaching toner from the donor roll and projecting the toner towards the photoconductive member so that the electrostatic fields generated by the latent image attract toner to develop the latent image. Single component development appears to offer advantages in low cost and design simplicity. However, the achievement of high reliability and easy manufacturability of the system may present a problem. Two component development systems have been used extensively in many types of printing machines. A two component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two component development system may have lower operating costs than a single component development system. Clearly, two component development systems and single component development systems each have their own advantages. Accordingly, it is desirable to combine these systems to form a hybrid development system having the desirable features of each system. For example, a hybrid system may employ a donor roll and a magnetic roller. The donor roll and the magnetic roller are electrically biased relative to one another. The magnetic roller transports two component developer material to the nip defined by the donor roll and magnetic roller. Toner is attracted to the donor roll from the magnetic roll. The donor roll is rotated relative to the photoconductive drum. The large difference in potential between the donor roll and latent image recorded on the photoconductive drum cause the toner to jump across the gap from the donor roll to the latent image so as to develop the latent image.

A scavengeless development system uses a donor roll for transporting charged toner to the development zone. A plurality of electrode wires are closely spaced to the donor roll in the development zone. An AC voltage is applied to the wires forming a toner cloud in the development zone. The electrostatic fields generated by the latent image attracts toner from the toner cloud to develop the latent image. A hybrid scavengeless development system employs a magnetic brush developer roller for transporting carrier having toner adhering triboelectrically thereto. The donor roll and magnetic roller are electrically biased relative to one another. Toner is attracted to the donor roll from the magnetic roll. The electrically biased electrode wires detach the toner from the donor roll forming a toner powder cloud in the development zone, and the latent image attracts the toner particles thereto. In this way, the latent image recorded on the photoconductive surface is developed with the toner particles. It has been found that unless the toner properties and many other process parameters such as wire tension, developer roller speed, and AC frequency are within specific latitudes, the electrode wires may start to vibrate. Vibration of the electrode wires produces unacceptable print defects, generally referred to as strobing. It is believed that a combination of electrical and mechanical forces causes the electrode wire to follow the configuration of the developer roller surface until the restoring force due to wire tension prevails and the wire snaps back. This is analogous to plucking a string which produces sustained vibrations. Vibrations of this type are clearly undesirable.

In a scavengeless development unit, an electrode wire is stretched across the donor roll and anchored below the roll surface. By being anchored below the roll surface, the wire forms an angle relative to the edge of the donor roll. This angle is termed the wire edge angle. This angle is required to insure uniform wire contact with the donor roll because the position of the anchor point varies slightly due to manufacturing tolerances. Holding the wire more than a small distance above the roll surface results in image deletions near the roll ends. Contrawise, holding the wire too low beneath the surface is a stress for an image defect referred to as edge banding, where the developed image density at the roll ends becomes excessive and not equal to the density at the center of the roll. Hence, the wire edge angle is a critical parameter for edge banding. The length of wire between the edge of the donor roll and the wire anchor point is the wire free span. Minimizing the wire edge angle will minimize edge banding. The length of the wire edge angle that can be held in manufacturing decreases as the wire free span increases. Edge banding is clearly an undesirable effect.

The wire free length is also a critical parameter for strobing. A long free span of wire is a stress resulting in strobing. The wire free span must be minimized to achieve a reasonable latitude relative to strobing. Thus, it is seen that there are two conflicting design requirements with respect to the wire free span. The wire free span must be maximized to decrease edge band effects and minimized to decrease strobing effects. These conflicting design requirements must be resolved in order to optimize a hybrid scavengeless development system. Various types of development systems have hereinbefore been used as illustrated by the following disclosures, which may be relevant to certain aspects of the present invention.

| |
|---|
| U.S. Pat. No. 4,868,600<br>Patentee: Hays, et al.<br>Issued: September 19, 1989<br>U.S. Pat. No. 4,984,019<br>Patentee: Folkins<br>Issued: January 8, 1991<br>U.S. Ser. No.: 07/759,362<br>Applicant: Bares<br>Filing Date: September 13, 1991<br>U.S. Ser. No.: 07/785,967<br>Applicant: Bares<br>Filing Date: October 31, 1991 |

The relevant portions of the foregoing disclosures may be briefly summarized as follows:

U.S. Pat. No. 4,868,600 describes an apparatus wherein a magnetic roll transports two component developer material to a transfer region. At the transfer region, toner from the magnetic roll is transferred to a donor roll. The donor roll transports the toner to a region opposed from a photoconductive surface having a latent image recorded thereon. A pair of electrode wires are positioned in the space between the photoconductive surface and the donor roll and are electrically biased to detach toner from the donor roll to form a toner powder cloud. Detached toner from the toner powder cloud develops the latent image.

U.S. Pat. No. 4,984,019 discloses a developer unit having a donor roll with electrode wires disposed adjacent thereto in a development zone. A magnetic roller transports developer material to the donor roll. Toner particles are attracted from the magnetic roller to the donor roller. When the developer unit is inactivated, the electrode wires are vibrated to remove contaminants therefrom.

U.S. Ser. No. 07/759,362 discloses a donor roll which advances toner to an electrostatic latent image recorded on a photoconductive member. A plurality of electrode wires are positioned in the space between the donor roll and the photoconductive surface. The electrode wires are electrically biased to detach toner from the donor roll so as to form a toner powder cloud in the space between the electrode wires and the photoconductive surface. Detached toner from the toner cloud develops the latent image. A damping material is coated on a portion of the electrode wires. The damping material dampens vibration of the electrode wires.

U.S. Ser. No. 07/785,967 describes a developer unit in which a donor roll advances toner to an electrostatic latent image recorded on a photoconductive surface. A plurality of electrode wires are positioned in the space between the donor roll and the photoconductive member. The electrode wires are tensioned. An electrical bias is applied to the electrode wires to detach the toner from the donor roll so as to form a toner cloud in the space between the electrode wires and photoconductive member. Detached toner from the toner cloud develops the latent image. Vibration of the electrode wires is detected. In response to the detected electrode wire vibration, the tension of the electrode wires is adjusted to substantially cancel the vibration thereof.

In accordance with one aspect of the present invention, there is provided an apparatus for developing a latent image recorded on a surface. The apparatus includes a housing defining a chamber storing at least a supply of toner therein. A donor member, spaced from the surface, is adapted to transport toner to a development zone adjacent the surface. An electrode member is positioned in the space between the surface and the donor member. The electrode wire is electrically biased to detach toner from the donor member to form a cloud of toner in the space between the electrode wire and the surface with the toner developing the latent image. Means are provided for supporting the electrode wire in tension. The supporting means contacts the electrode wire at at least two points with one of the contact points being selected to minimize the wire edge angle between the end of the donor member and the contact point. The other contact point is selected to minimize the wire free span. This minimizes edge banding and strobing effects.

Pursuant to another aspect of the present invention, there is provided an electrophotographic printing machine of the type in which an electrostatic latent image recorded on a photoconductive member is developed with toner to form a visible image thereof. The printing machine includes a housing defining a chamber storing at least a supply of toner therein. A donor member, spaced from the photoconductive member, is adapted to transport toner to a development zone adjacent the photoconductive member. An electrode wire is positioned in the space between the photoconductive member and the donor member. The electrode wire is electrically biased to detach toner from the donor member to form a cloud of toner in the space between the electrode wire and the photoconductive member with the toner developing the latent image. Means are provided for supporting the electrode wire in tension. The supporting means contacts the electrode wire at at least two points with one of the contact points being selected to minimize the wire edge angle the other contact points is selected to minimize the wire free span. This minimizes edge banding and strobing effects.

The features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
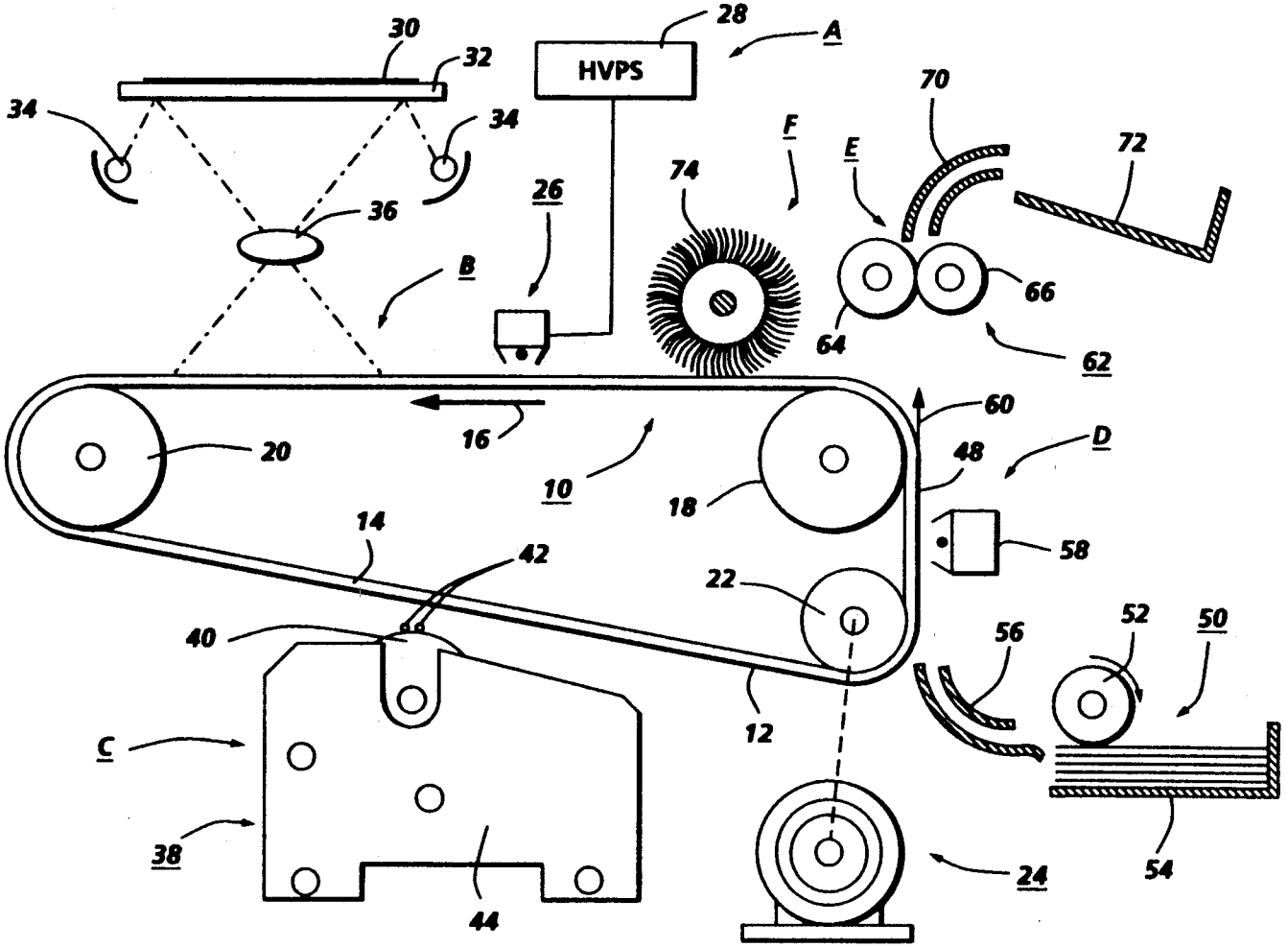
FIG. 3 is a schematic elevational view of an illustrative electrophotographic printing machine incorporating the FIG. 1 development apparatus therein.

Referring initially to FIG. 3, there is shown an illustrative electrophotographic printing machine incorporating the development apparatus of the present invention therein. The printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. However, one skilled in the art will appreciate that photoconductive belt 10 may be made from any suitable photoconductive material. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a belt drive. Belt 10 is maintained in tension by a pair of springs (not shown) resiliently urging tension in roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lens 34 flash light rays onto original document 30. The light rays reflected from original document 30 are transmitted through a lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

One skilled in the art will appreciate that in lieu of the light lens system hereinafter described, a raster output scanner (ROS) may be employed. A ROS selectively discharges the charged portion of the photoconductive member in a series of horizontal scan lines with each line having a certain number of pixels per inch. A ROS may include lasers with rotating polygon mirror blocks, solid state image modulator bars, or LED array light bars.

After the electrostatic latent image has been recorded on photoconductive surface 12, belt 10 advances the latent image to development station C. At development station C, a development system indicated generally by the reference numeral 38, develops the latent image recorded on the photoconductive surface. Preferably, development system 38 includes donor roll 40 and electrode wires 42. Electrode wires 42 are electrically biased relative to donor roll 40 to detach toner therefrom so as to form a toner powder cloud in the gap between the donor roll and the photoconductive surface. The latent image recorded on the photoconductive surface attracts toner particles from the toner powder cloud forming a toner powder image thereon. Donor roll 40 is mounted, at least partially, in the chamber of developer housing 44. The chamber in developer housing 44 has a supply of developer material therein. The developer material is a two component developer material of at least carrier granules with toner particles adhering triboelectrically thereto. A magnetic roller disposed interiorly of the chamber of housing 44 conveys the developer material to the donor roll. The magnetic roller is electrically biased relative to the donor roll so that the toner particles are attracted from the magnetic roll to the donor roll. The development apparatus will be discussed hereinafer, in greater detail, with reference to FIG. 1.

With continued reference to FIG. 3, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into sheet guide 56. Sheet guide 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transfer powder image to sheet 48. Fuser assembly 62 includes a heated fuser roller 64 and a backup roller 66. Sheet 48 passes between fuser roller 64 and backup roller 66 with the toner image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at claiming station F. Claiming station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
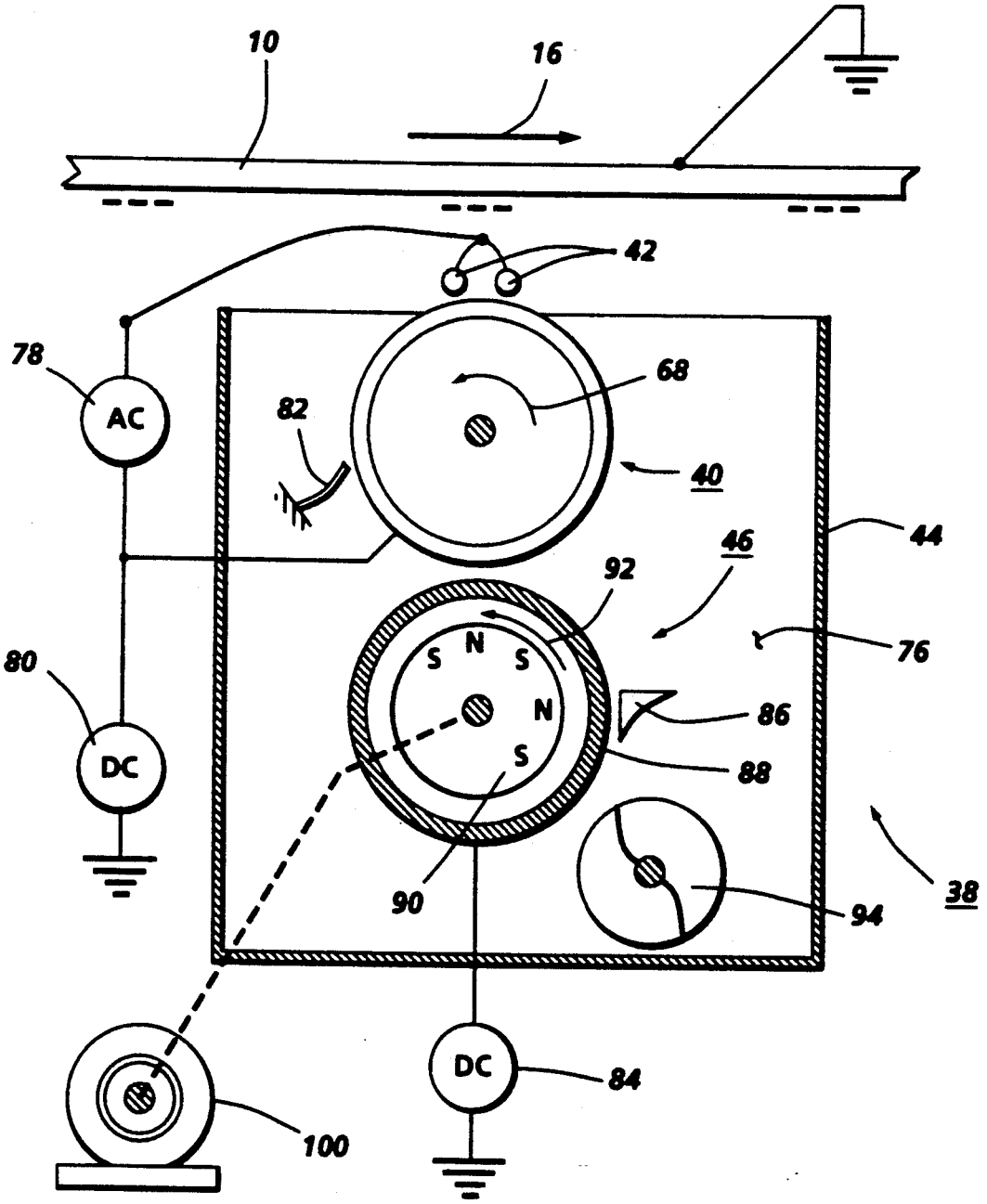
FIG. 1 is a schematic elevational view showing the development apparatus of the present invention.

Referring now to FIG. 1, there is shown development system 38 in greater detail. As shown thereat, development system 38 includes a housing 44 defining a chamber 76 for storing a supply of developer material therein. Donor roll 40, electrode wires 42 and magnetic roller 46 are mounted in chamber 76 with housing 44.

The donor roller can be rotated in either the with or against direction relative to the direction of movement of belt 10. In FIG. 1, donor roll 40 is shown rotating in the direction of arrow 68. Similarly, the magnetic roller can be rotated in either the with or against direction relative to the direction of motion of belt 10 as indicated by arrow 16. In FIG. 1, magnetic roller 46 is shown rotating in the direction of arrow 92. Donor roll 40 is preferably made from an anodized aluminum.

Development system 38 has electrode wires 42 which are disposed in the space between belt 10 and donor roll 40. A pair of electrode wires are shown extending in a direction substantially parallel to the longitudinal axis of the donor roll. The electrode wires are made from one or more thin stainless steel wires which are closely spaced from donor roll 40. The distance between the wires and the donor roller ranges from about 10 microns to about 25 microns or the thickness of the toner layer on the donor roller. The wires are self spaced from the donor roller by the thickness of the toner on the donor roller.

With continued reference to FIG. 1, an alternating electrical bias is applied to the electrode wires by an AC voltage source 78. The applied AC voltage establishes an alternating electrostatic field between the wires and the donor roller which is effective in detaching toner from the surface of the donor roller and forming a toner powder cloud about the wires. The toner of the cloud is substantially in contact with belt 10. The magnitude of the AC voltage is relatively low, in the order of 200 to 600 volts peak at a frequency ranging from about 3 kilohertz to about 10 kilohertz. A DC bias supply 80, which applies approximately 300 volts to donor roll 40, establishes an electrostatic field between photoconductive surface 12 or belt 10 and donor roll 40 for attracting the detached toner particles from the cloud surrounding the wires to the latent image recorded on the photoconductive surface. At a spacing ranging from about 10 microns to about 40 microns between the electrode wires and the donor roller, an applied voltage of 200 to 600 volts produces a relatively large electrostatic field without risk of air breakdown. The use of a dielectric coating and electrode wires with the donor roller helps to prevent shorting of the applied AC voltage. A cleaning blade 82 strips all of the toner from donor roller 40 after development so that the magnetic roller 46 meters as fresh toner to a clean donor roller. A DC bias supply 84, applying approximately 100 volts to magnetic roller 46, establishes an electrostatic field between magnetic roller 46 and donor roller 40 so that the electrostatic field established causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member or sleeve 88 made preferably from aluminum and having the exterior circumferential surface thereof roughened. An elongated multi-pole magnet 90 is positioned interiorly of and spaced from the tubular member. Elongated magnet 90 is mounted stationarily. Tubular member 88 is mounted on suitable ball bearings and rotates in the direction of arrow 92. Motor 100 rotates tubular member 88. Developer material is attracted to tubular member 88 and advances thereabout into the nip defined by donor roll 40 and magnetic roller 46. Toner particles are attracted from the carrier granules on the magnetic roller to the donor roller.

With continued reference to FIG. 1, augers indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chambers of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge.

Figure 2:
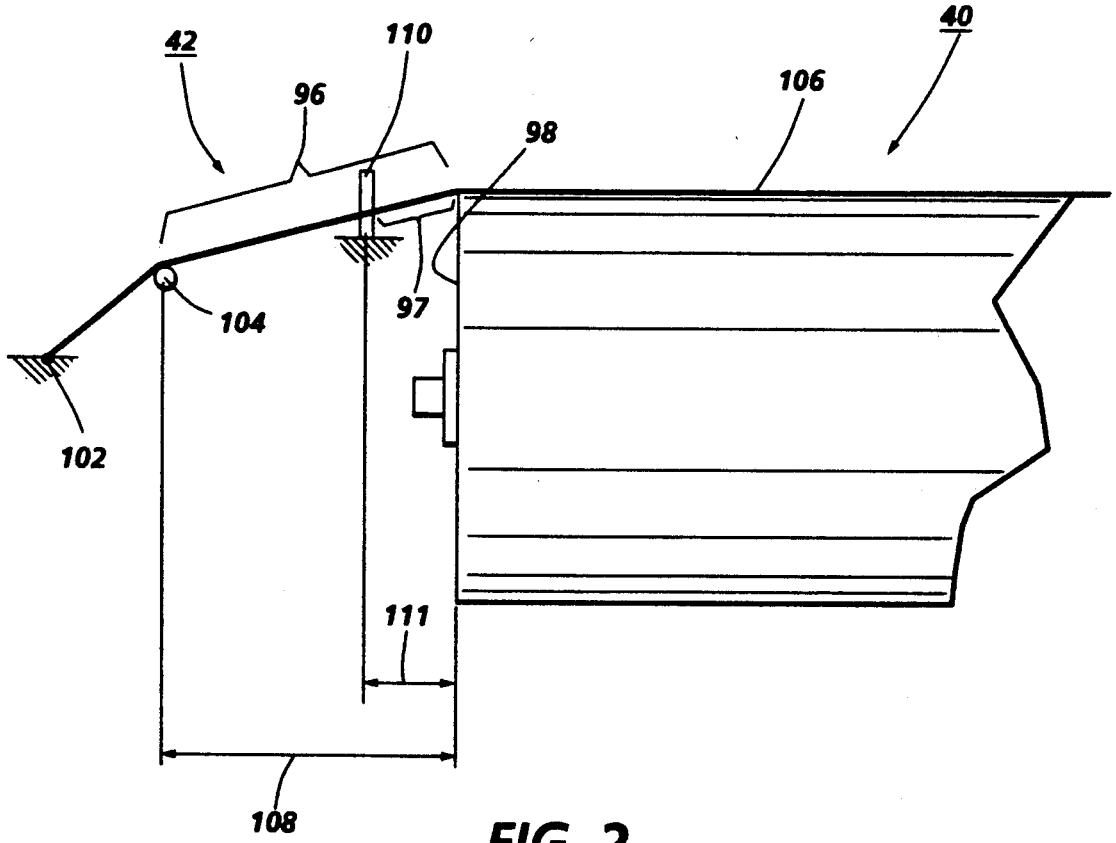
FIG. 2 depicts the mounting arrangement for the electrode wires used in the FIG. 1 development system.

Referring now to FIG. 2, the tangential degree of freedom of the electrode wires relative to the donor roll surface is constrained at a point close to the ends of the donor roll to minimize strobing. The radial position of the wire end is held at a point sufficiently far from the end of the donor roll so that a small wire edge angle is formed to minimize edge banding. In FIG. 2, the electrode wire 42 extends from edge 98 of donor roll 40 to anchor point 102 where it is secured fixedly to the machine frame. The wire edge angle is a critical parameter for edge banding. Minimizing the wire edge angle will minimize edge banding. The wire edge angle is defined as the angle between the longitudinal axis of the donor roller 40 and the wire span 96. The minimum edge angle that can be held in manufacturing decreases as wire span 96 increases. To control edge banding, the upper limit of the wire edge angle is approximately 0.5°. To maintain a 0.5° angle with a height tolerance of 0.010 inches, wire span 96 must have a horizontal distance from edge 98 to pin 104 of at least 1.1 inches. This is achieved by positioning horizontal pin 104 in engagement with electrode wire 42 horizontal at a distance of about 1.1 inches from edge 98 of donor roll 40 defining wire span 96. Pin 104 is located at a distance less than 0.010 inches vertically downwardly from a horizontal plane tangential to line 106 of donor roll 40. This horizontal distance is indicated by reference numeral 108 as about 1.1 inches. A horizontal distance of 1.1 inches in combination with a vertically downward displacement of less than 0.010 inches specifically locates pin 104 such that the wire span 96 forms an angle of less than 0.5°.

With continued reference to FIG. 2, the wire free span is a critical parameter for strobing. In order to control strobing within a reasonable latitude, it is necessary to maintain the wire free span 97 less than 0.3 inches. It has been found that a vertically mounted pin, i.e. a lateral force pin 110, contacting the wire close to the donor roll edge 98, i.e. no greater than 0.3 inches from edge 98 can locate the wire tangentially, i.e., laterally, and produce the same strobing performance as an anchor point located at 0.3 inches from donor roll edge 98. Lateral force pin 110 is constructed in such a way that it does not support wire span 96 vertically, and does not affect the wire edge angle. Lateral force pin 110 exerts a lateral or tangential force on wire free span 97 rather than a vertical or radial force. It has been found that the wire edge angle may be controlled independently by setting the wire vertical position with horizontally mounted pin 104 placed under the wire at a location beyond that of the lateral force pin 110 in the direction outwardly from donor roll edge 98. Reference numeral 111 defines the horizontal location of lateral force pin 110 as being no greater than 0.3 inches from edge 98 of donor roll 40. In addition, any suitable element at the same location as pin 110 which will constrain the tangential or horizontal position of the electrode wire while permitting movement in a vertical or radial direction is sufficient to optimize strobing and edge band defects.

In recapitulation, it is evident that the development apparatus of the present invention includes a mounting arrangement for the electrode wires wherein the ends of the electrode wires are supported in both a horizontal and a vertical direction at two distinctly different locations. The location of the vertical support provides minimization of the wire edge angle so as to minimize edge banding with the location of the horizontal support being such as to minimize strobing effects.

It is, therefore, apparent that there has been provided in accordance with the present invention, a development system that fully satisfies the aims and advantages hereinbefore set forth. While this invention has been described in conjunction with a preferred embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. An apparatus for developing a latent image recorded on a surface, including:

a housing defining a chamber storing at least a supply of toner therein;

a donor member spaced from the surface and adapted to transport toner to a development zone adjacent the surface;

an electrode wire positioned in the space between the surface and said donor member, said electrode wire being electrically biased to detach toner from said donor member to form a cloud of toner in the space between said electrode wire and the surface with the toner developing the latent image; and means for supporting said electrode wire in tension, said supporting means contacting said electrode wire at at least two points with one of the contact points being selected to minimize the wire edge angle and the other of the contact points being selected to minimize the wire free span to minimize edge banding and strobing effects.

2. An apparatus according to claim 1, wherein said donor member includes a roll.

3. An apparatus according to claim 2, wherein said supporting means fixedly secures an end of said electrode wire extending from the end of said donor roll at an anchor point.

4. An apparatus according to claim 3, wherein said supporting means includes a first member, positioned intermediate the end of said donor roll and the anchor point, engaging said electrode wire and applying a tangential force thereon.

5. An apparatus according to claim 4, wherein said supporting means includes a second member, positioned intermediate said first member and the anchor point, engaging said electrode wire and applying a vertically upward radial force thereon determining a wire edge angle.

6. An apparatus according to claim 5, wherein the wire edge angle is about 0.5°.

7. An apparatus according to claim 6, wherein the length of said electrode wire between the end of said donor roll and said second member is at least 1.1 inches.

8. An apparatus according to claim 4, wherein the length of said electrode wire between the end of said donor roll and said first member is less than 0.3 inches.

9. An electrophotographic printing machine of the type in which an electrostatic latent image recorded on a photoconductive member is developed with toner to form a visible image thereof, wherein the improvement includes:

a housing defining a chamber storing at least a supply of toner therein;

a donor member spaced from the photoconductive member and adapted to transport toner to a development zone adjacent the photoconductive member;

an electrode wire positioned in the space between the photoconductive member and said donor member, said electrode wire being electrically biased to detach toner from said donor member to form a cloud of toner in the space between said electrode wire and the photoconductive member with toner developing the latent image; and means for supporting said electrode wire in tension, said supporting means contacting said electrode member at least two points with one of the contact points being selected to minimize the wire edge angle and the other of the contact points being selected to minimize the wire free span to minimize edge banding and strobing effects.

10. A printing machine according to claim 9, wherein said donor member includes a roll.

11. A printing machine according to claim 10, wherein said supporting means fixedly secures an end of said electrode wire extending from the end of said donor roll at an anchor point.

12. A printing machine according to claim 11, wherein said supporting means includes a first member, positioned intermediate the end of said donor roll and the anchor point, engaging said electrode wire and applying a tangential force thereon.

13. A printing machine according to claim 12, wherein said supporting means includes a second member, positioned intermediate said first member and the anchor point, engaging said electrode wire and applying a vertically upward radial force thereon determining the wire edge angle.

14. A printing machine according to claim 13, wherein the wire edge angle is about 0.5°.

15. A printing machine according to claim 14, wherein the length of said electrode wire between the end of said donor roll and said second member is at least 1.1 inches.

16. A printing machine according to claim 12, wherein the length of said electrode wire between the end of said donor roll and said first member is less than 0.3 inches.

* * * * *